US006676152B2

(12) United States Patent
Gonthier

(10) Patent No.: US 6,676,152 B2
(45) Date of Patent: Jan. 13, 2004

(54) BASE FOR SUPPORTING A BOOT ON A BOARD, THE BASE INCLUDING A DEVICE FOR ANGULAR ORIENTATION IN RELATION TO THE BOARD

(75) Inventor: Jean-François Gonthier, Viuz la Chiesaz (FR)

(73) Assignee: Salomon S.A., Metz-Tessy (FR)

( * ) Notice: Subject to any disclaimer, the term of this patent is extended or adjusted under 35 U.S.C. 154(b) by 22 days.

(21) Appl. No.: 09/990,305

(22) Filed: Nov. 23, 2001

(65) Prior Publication Data

US 2002/0063413 A1 May 30, 2002

(30) Foreign Application Priority Data

Nov. 24, 2000 (FR) ..... 00 15374

(51) Int. Cl.[7] ..... A63C 9/00

(52) U.S. Cl. ..... 280/623; 280/633; 280/634; 280/14.22

(58) Field of Search ..... 280/611, 613, 280/623, 626, 627, 628, 629, 633, 634, 636, 14.21, 14.22, 14.24

(56) References Cited

U.S. PATENT DOCUMENTS

| | | | | | |
|---|---|---|---|---|---|
| 5,236,216 | A | * | 8/1993 | Ratzek | 280/14.21 |
| 5,499,837 | A | * | 3/1996 | Hale et al. | 280/14.21 |
| 5,553,883 | A | | 9/1996 | Erb | 280/607 |
| 5,765,853 | A | | 6/1998 | Erb | 280/607 |
| 5,803,481 | A | * | 9/1998 | Eaton et al. | 280/14.24 |
| 5,826,910 | A | | 10/1998 | Ricks et al. | 280/618 |
| 5,876,045 | A | * | 3/1999 | Acuna, Jr. | 280/14.24 |
| 5,915,718 | A | * | 6/1999 | Dodge | 280/14.21 |
| 5,941,552 | A | * | 8/1999 | Beran | |
| 5,947,508 | A | * | 9/1999 | Graf et al. | 280/613 |
| 5,984,346 | A | * | 11/1999 | Keller | 280/607 |
| 6,007,085 | A | * | 12/1999 | Rigal et al. | 280/14.24 |
| 6,065,768 | A | | 5/2000 | Lee | 280/613 |
| 6,068,283 | A | * | 5/2000 | Couderc et al. | 280/618 |
| 6,203,051 | B1 | * | 3/2001 | Sabol | 280/14.24 |
| 6,209,890 | B1 | | 4/2001 | Couderc | 280/14.2 |
| 6,302,411 | B1 | * | 10/2001 | Huffman et al. | 280/14.24 |
| 2001/0038183 | A1 | * | 11/2001 | Gorza et al. | 280/14.24 |

FOREIGN PATENT DOCUMENTS

| | | | | |
|---|---|---|---|---|
| DE | 197 27 368 | * | 1/1999 | A63C/9/00 |
| EP | 0891793 | | 1/1999 | |
| EP | 0898990 | | 3/1999 | |
| FR | 2726480 | * | 5/1996 | A63C/9/18 |

* cited by examiner

*Primary Examiner*—Brian L. Johnson
*Assistant Examiner*—Bridget Avery
(74) *Attorney, Agent, or Firm*—Greenblum & Bernstein, P.L.C.

(57) ABSTRACT

A base for supporting a boot on a board, the base having a device for angular orientation in relation to the board. The device includes a circular opening provided in the base and a disk, the latter being nested in the opening of the base to retain the base on the board. An abutment limits an axial displacement of the disk away from the upper surface of the base.

16 Claims, 2 Drawing Sheets

BASE FOR SUPPORTING A BOOT ON A BOARD, THE BASE INCLUDING A DEVICE FOR ANGULAR ORIENTATION IN RELATION TO THE BOARD

CROSS-REFERENCE TO RELATED APPLICATION

This application is based upon French Patent Application No. 00 15374, filed on Nov. 24, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to bases for supporting a boot on a board, the base including a device for angular orientation in relation to the board, the latter being adapted for sporting activities.

2. Description of Background and Relevant Information

Bases of the aforementioned type can be used on gliding or rolling boards, for sports such as snowboarding, water skiing or wakeboarding, skateboarding, or the like.

An orientation device is obtained by providing a circular opening in the base, the opening being provided to receive a disk, the latter making it possible to retain the base on the board in a selected angular position. The disk itself is detachably affixed to the board by means such as screws. It suffices to loosen the disk retaining screws to orient the base, then to re-tighten the screws to maintain the base in the desired position.

The necessary manipulations for adjusting the angular position frequently causes the disk and the base to separate, and this occurs even more easily in situations where the device is also displaced translationally in relation to the board. Frequently, the disk falls into the snow, the water, or onto the ground. This involves manipulations and/or searches for reassembling the elements of the device before positioning it on the board.

SUMMARY OF THE INVENTION

An object of the invention in particular is to facilitate the positioning of a base on a board.

To this end, the invention proposes a base for supporting a boot on a board, the base including a device for angular orientation in relation to the board, the device including a circular opening provided in the base and a disk. The base has an upper surface provided to be opposite a boot, and a lower surface provided to be above the board, the circular opening extending through the base from the upper surface down to the lower surface, the disk being nested at least partially in the opening, from the upper surface of the base, to retain the base on the board. An abutment limits axial displacement of the disk away from the upper surface of the base.

Thus, when the disk retaining screws are loosened, the disk remains affixed to the base. As a result, it is not necessary to reassemble the disk with the base. The positioning of the base on the board is easier.

BRIEF DESCRIPTION OF DRAWINGS

Other characteristics and advantages of the invention will be better understood from the description that follows, with reference to the annexed drawings showing, by way of a non-limiting example, how the invention can be embodied, and in which.

DETAILED DESCRIPTION OF THE INVENTION

An embodiment of the invention is described hereinafter by means of FIGS. 1–3.

Figure 1:
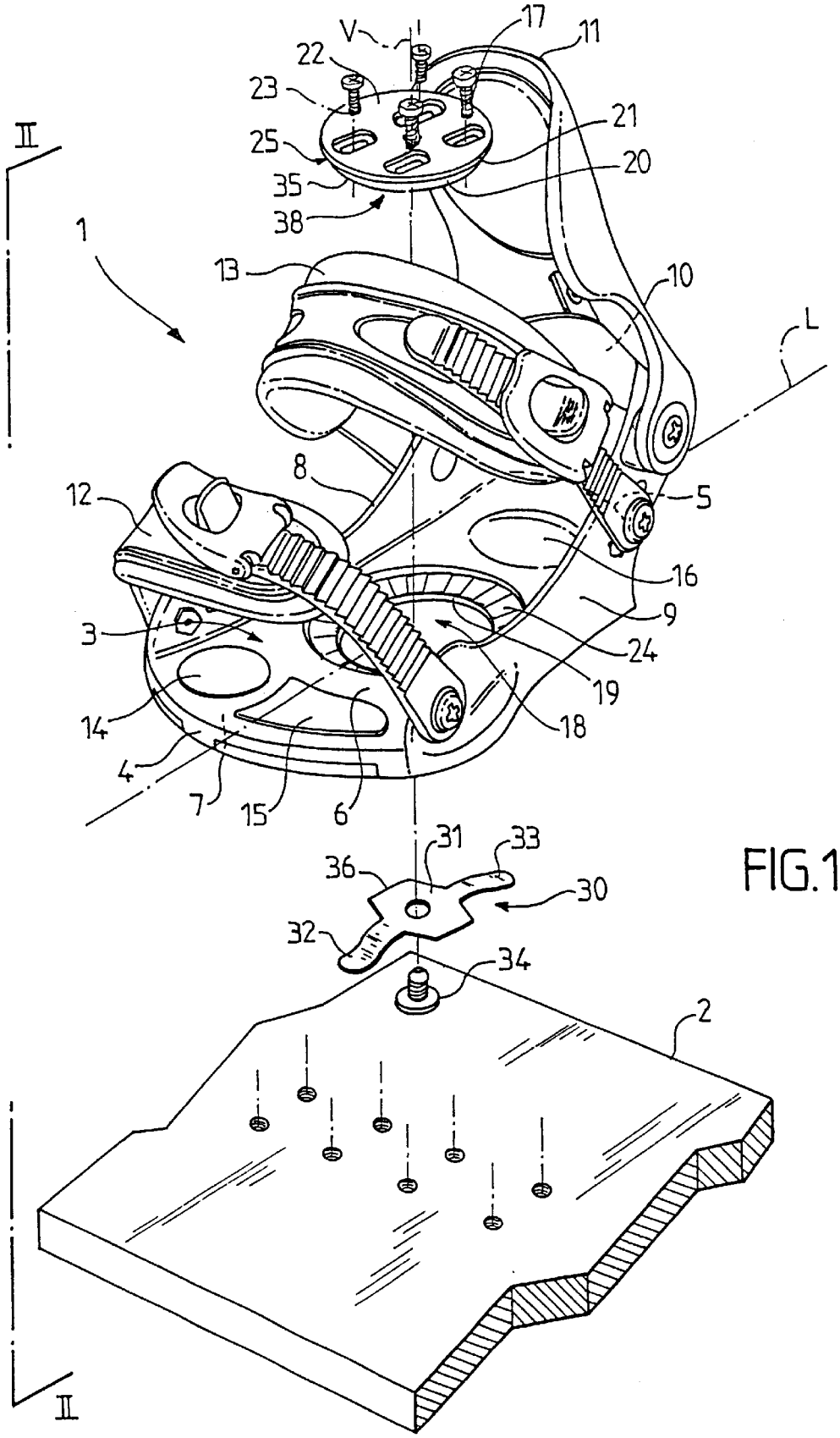
FIG. 1 is an exploded perspective view of an assembly for retaining a boot on a board, the assembly including a base according to the invention.

A retaining assembly 1, provided to detachably retain a boot, not shown, on a board 2, is shown in FIG. 1.

In a known manner, the retaining assembly 1 includes a base 3 that extends along a longitudinal direction L of the assembly, between a front end 4 and a rear end 5. The base 3 has an upper surface 6 provided to be opposite the boot sole, as well as a lower surface 7 provided to be above the board 2.

Preferably, but not necessarily, lateral flanges 8, 9 are provided for positioning the boot along a transverse direction of the assembly 1. One can also provide an arch 10 for connecting the flanges 8, 9 to one another toward the rear end 5, as well as a rear support element 11 connected to the flanges 8, 9, for example, by a journal.

The flanges 8, 9 and the arch 10 can form a unitary piece with the base 3, or they can be adjustably or non-adjustably attached on the base 3.

According to the embodiment shown, a retaining mechanism, shown in the form of two linkages or straps 12, 13, makes it possible to detachably retain the boot above the base 3. To this end, the linkages are provided with removable fasteners.

Means other than the linkages 12, 13, such as a latch affixed to the base and associated with an insert affixed to the boot, for example, could be used.

One or more pads 14, 15, 16 can also be provided on the base 3 to absorb impacts or to assume the shape of the sole. Each pad has at least one portion of deformable material, i.e., which is capable of recovering its initial shape as soon as a downward force upon it is removed. This material can be a synthetic material containing polyurethane, silicone, rubber, or the like.

The retaining assembly 1 is provided with an angular orientation device, which makes it possible to orient the retaining assembly in a direction that is within a plane substantially parallel to the board 2, on the one hand, and to maintain the assembly in a fixed position for operating the board once the orientation has been selected.

The orientation device includes a disk 17 and a circular opening 18 that extends through the base 3, between the upper surface 6 and the lower surface 7. The respective shapes of the circular opening 18 and of the disk 17 are provided for nesting the disk 17 in the opening 18 from the upper surface 6 of the base 3.

Figure 2:
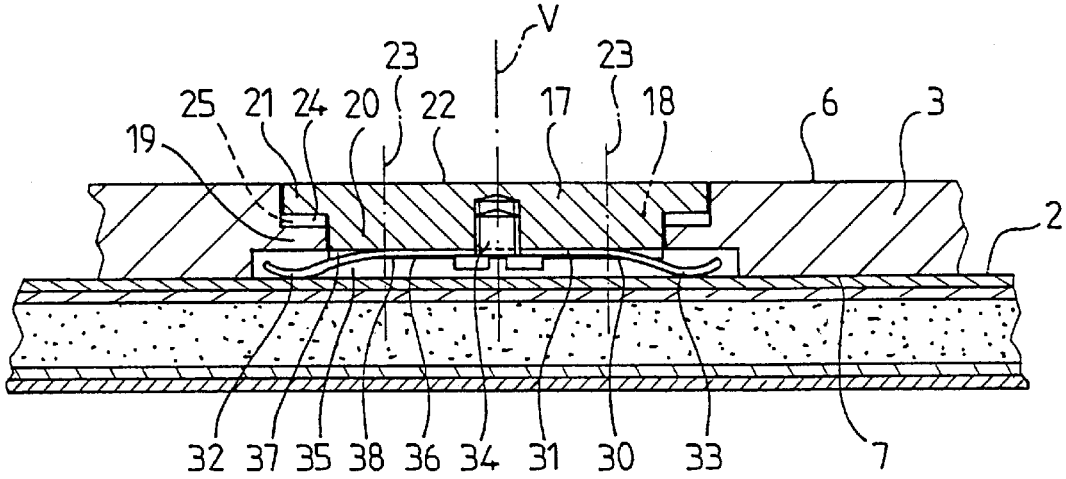
FIG. 2 is a cross-section along the line II—II of FIG. 1, in the case where the retaining assembly is held by the disk.
Figure 3:
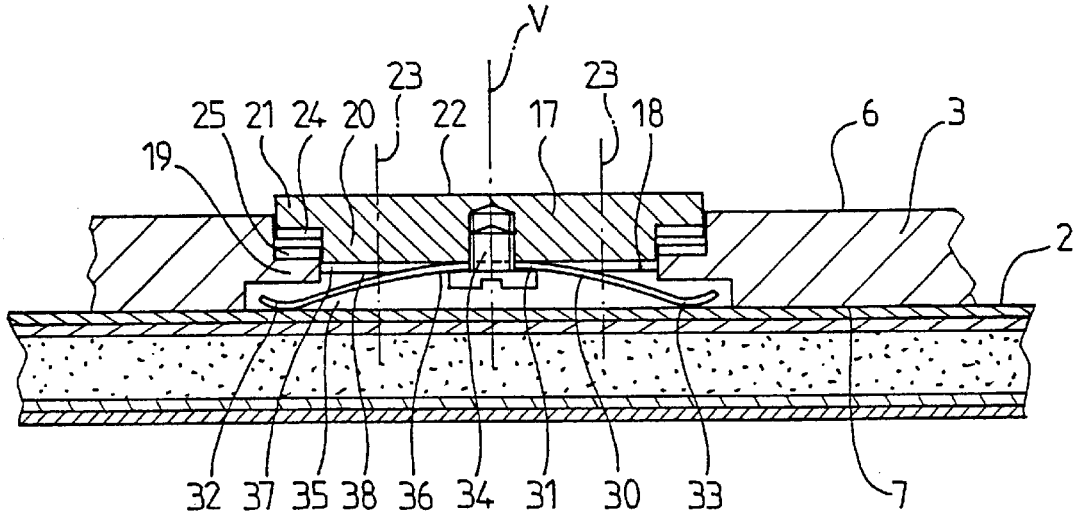
FIG. 3 is similar to FIG. 2, in the case where the retaining assembly is not held by the disk.

To this end, as seen better in FIGS. 2 and 3, the opening 18 has a shoulder 19 that is set back with respect to the upper surface 6 of the base 3. The disk 17 has a cylinder, or cylindrical portion, 20 overlaid by a shoulder 21 positioned near top surface 22.

Other shapes could be selected for the opening 18 and the disk 17. For example, a portion of the opening and a portion of the disk could each have a conical shape.

Furthermore, the disk 17 is retained on the board 2 by means such as screws, each having a shaft 23. Four screws have been provided here, each arranged at the vertex of a square measuring, for example, 40 millimeters (mm) square. However, a different number of screws is suitable, such as three screws arranged at the vertices of a triangle, or six screws arranged at the vertices of a hexagon.

When the screws are tightened, as is the case in FIG. 2, the retaining assembly is immobilized on the board 2.

To prevent a rotation of the base 3 with respect to the disk 17, a peripheral toothing 24 of the disk 17 beneath the shoulder 21 is engaged with a peripheral toothing 25 of the base 3 on the shoulder 19. The rotational immobilization of the base 3 is due to a positive connection of the base 3 and of the disk 17.

Nevertheless, one could provide the shoulders 19, 21 to be in support on one another via respective planar surfaces. In this case, the base 3 would be rotationally immobilized by friction.

According to the invention, an abutment 30 is associated with the angular orientation device to limit an axial displacement of the disk 17 away from the upper surface 6 of the base 3.

As seen better in FIG. 1, the abutment 30 is obtained in the form of a washer 31 whose dimensions are less than the diameter of the disk, and which is extended radially by two opposite arms 32, 33 whose span is greater than the diameter of the disk. These arms are vertically flexible, in the manner of leaf springs, and they are bent away from the disk. A retaining means, shown in the form of a screw 34, retains the abutment beneath the disk 17. Other means could be used, such as a rivet, or a stud extending from the disk that extends through a central opening of the washer, and whose head is pushed back against the washer in the manner of a rivet head.

As might be better understood with reference to FIGS. 2 and 3, the ends of the arms 32, 33 of the abutment 30 are located beneath the shoulder 19 of the base 3, in a lower portion 35 of the opening 18.

A rectilinear portion 36 of the washer 31 is housed in a groove 37 of the base 38 of the disk 17, in order to mount the abutment 30 on the disk 17 in a position where the arms 32, 33 do not hinder the passage of the screws 23 retaining the disk 17.

The abutment 30 is affixed to the disk 17 after the latter is nested in the circular opening 18.

To adjust the angular position of the retaining assembly with respect to the board, it suffices to loosen the screws 23, as is the case in FIG. 3.

The concave natural shape of the abutment 30 is such that the arms 32, 33 take support on the board 2 to push the disk 17 away from the upper surface 6. As a result, after the screws 23 retaining the disk 17 have been loosened, the disk 17 is in a raised position for which the toothings 24, 25 are not engaged with one another.

This makes it easier for the base 3 to rotate with respect to the disk 17.

After adjustment, it suffices to re-tighten the screws retaining the disk 17 to reassume the position for holding the device according to FIG. 2. In this case, a slight prestress is exerted on the arms 32, 33 of the abutment 30. Due to their flexibility, the arms 32, 33 are elastically deformed, in a reversible manner, between the disk 17 and the board 2.

It is not necessary for the abutment 30 to fulfill an elastic function. The shape of the teeth in the toothings 24, 25, which can be triangular, for example, induces a natural lift of the disk 17 if the base 3 is rotated by hand when the screws 23 are loosened. However, the axial clearance of the disk must be greater than the height of the teeth.

The angular orientation device according to the invention facilitates the mounting of a retaining assembly 1 on a board, or the angular orientation adjustment. Indeed, the disk 17 remains naturally affixed to the base 3 due to the abutment 30. Therefore, the user does not have to assemble the disk 17 with the base 3, the assembly being provided during the manufacture of the retaining assembly.

The invention can be embodied with all of the materials used according to all of the techniques known to a person with ordinary skill in the art. In particular, the abutment 30 can be made of metal, metallic alloy, or out of a synthetic material, such as a reinforced or non-reinforced plastic.

The invention is not limited to the particulars of the example described hereinabove, and includes all of the technical equivalents that fall within the scope of the claims that follow.

In particular, the abutment 30 could have other shapes, or could have a different number of arms.

Furthermore, the base according to the invention may be devoid of means for retaining a boot. In this case, the base may or may not be demarcated by edges, may or may not be provided with pads, may or may not be associated with a rear support element.

What is claimed is:

1. A base for supporting a boot on a board, the base comprising:

a device for angular orientation in relation to the board, the device including a circular opening provided in the base and a disk, the base having an upper surface provided to be opposite a boot, and a lower surface provided to be above the board, the circular opening extending through the base from the upper surface down to the lower surface, the disk being nested at least partially in the opening, from the upper surface of the base, to retain the base on the board, wherein an abutment limits an axial displacement of the disk away from the upper surface of the base, the abutment being extended to have a span greater than a diameter of the opening of the base.

2. A base according to claim 1, wherein the opening has a shoulder that is set back with respect to the upper surface, and wherein the disk has a cylinder overlaid toward its top by a shoulder.

3. A base according to claim 1, wherein a screw connects said abutment to said disk.

4. A base according to claim 2, wherein the shoulders respectively have a peripheral toothing.

5. A base for supporting a boot on a board, the base comprising:

a device for angular orientation in relation to the board, the device including a circular opening provided in the base and a disk, the base having an upper surface provided to be opposite a boot, and a lower surface provided to be above the board, the circular opening extending through the base from the upper surface down to the lower surface, the disk being nested at least partially in the opening, from the upper surface of the base, to retain the base on the board, wherein an abutment limits an axial displacement of the disk away from the upper surface of the base, and the abutment comprising a washer having radially extended arms, the arms extending beneath a shoulder of the circular opening of the base.

6. A base according to claim 5, wherein the washer is extended by two arms.

7. A base according to claim 5, wherein a rectilinear portion of the washer is housed in a groove of the base of the disk.

8. A base according to claim 5, wherein the abutment has a concave natural shape for biasing the disk away from the upper surface.

9. An assembly for retaining a boot on a board, the assembly comprising:

a base for supporting the boot on the board, the base including a device for angular orientation in relation to the board, the device including a circular opening provided in the base and a disk, the base having an upper surface provided to be opposite the boot, and a lower surface provided to be above the board, the circular opening extending through the base from the upper surface down to the lower surface, the disk being nested at least partially in the opening, from the upper surface of the base, to retain the base on the board, wherein an abutment limits an axial displacement of the disk away from the upper surface of the base, the abutment being extended to have a span greater than a diameter of the opening of the base.

10. A snowboard binding comprising:

a base for supporting a boot, said base having an upper surface adapted to face the boot and a lower surface adapted to face a snowboard;

an angular orientation device to orient the binding on the snowboard, said device comprising:

an opening extending through said base from said upper surface to said lower surface;

a disk positioned on said base over said opening, said base having a structure to peripherally support said disk; and an abutment affixed to a lower surface of said disk, said abutment having a structure allowing said disk to be raised upwardly relative to said base while maintaining a connection between said disk and said base.

11. A snowboard binding according to claim 10, wherein said structure of said base to peripherally support said disk comprises a peripheral shoulder of said base.

12. A snowboard binding according to claim 10, wherein said structure of said abutment allowing said disk to be raised upwardly relative to said base while maintaining a connection between said disk and said base comprises projecting arms adapted to be engaged with said base at least upon upward movement of said disk relative to said base.

13. A snowboard binding according to claim 10, wherein a screw affixes said abutment to said lower surface of said disk.

14. A snowboard binding according to claim 10, further comprising:

a pair of laterally opposed flanges upwardly projecting from said base, adapted to position the boot on said base;

an arch connecting rear ends of said flanges; and a rear support element journalled to said flanges.

15. A snowboard binding comprising:

a base for supporting a boot, said base having an upper surface adapted to face the boot and a lower surface adapted to face a snowboard;

an angular orientation device to orient the binding on the snowboard, said device comprising:

an opening extending through said base from said upper surface to said lower surface;

a disk positioned on said base over said opening, said base having a structure to peripherally support said disk; and means for allowing said disk to be raised upwardly relative to said base a limited extent, while preventing said disk from becoming detached from said base, said means including an abutment extending beneath and beyond said opening.

16. A snowboard binding comprising:

a base for supporting a boot, said base having an upper surface adapted to face the boot and a lower surface adapted to attach too a snowboard;

an angular orientation device to orient the binding on the snowboard, said device comprising:

an opening extending through said base from said upper surface to said lower surface;

a disk positioned on said base over said opening, said base having a structure to peripherally support said disk; and means for allowing said disk to be raised upwardly relative to said base a limited extent, while preventing said disk from becoming detached from said base when said base is detached from the snowboard.

* * * * *